US009217328B2

(12) United States Patent
Yang et al.

(10) Patent No.: US 9,217,328 B2
(45) Date of Patent: Dec. 22, 2015

(54) AUTOMATED SIDEWALL CORING

(75) Inventors: Bo Yang, Sugar Land, TX (US); Steve E. Buchanan, Pearland, TX (US); Akio Kita, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 728 days.

(21) Appl. No.: 13/500,538

(22) PCT Filed: Oct. 8, 2010

(86) PCT No.: PCT/US2010/051926

§ 371 (c)(1), (2), (4) Date: Sep. 4, 2012

(87) PCT Pub. No.: WO2011/044427

PCT Pub. Date: Apr. 14, 2011

(65) Prior Publication Data

US 2012/0318579 A1 Dec. 20, 2012

Related U.S. Application Data

(60) Provisional application No. 61/250,319, filed on Oct. 9, 2009.

(51) Int. Cl.

| | |
|---|---|
| ***E21B 49/06*** | (2006.01) |
| ***E21B 44/02*** | (2006.01) |
| ***E21B 44/04*** | (2006.01) |
| ***E21B 44/00*** | (2006.01) |

(52) U.S. Cl.

CPC ..... *E21B 49/06* (2013.01); *E21B 44/005* (2013.01); *E21B 44/02* (2013.01); *E21B 44/04* (2013.01)

(58) Field of Classification Search

CPC ..... E21B 49/06; E21B 25/16; E21B 44/005; E21B 44/02; E21B 44/04; E21B 44/06

USPC ..... 175/44, 26

See application file for complete search history.

(56) References Cited

U.S. PATENT DOCUMENTS 4,714,449 A 12/1987 Woerner et al.
4,914,591 A 4/1990 Warren et al.

(Continued)

FOREIGN PATENT DOCUMENTS

MX PA01009429 A 7/2004

OTHER PUBLICATIONS

Abdullah Humaid Al Jarwan, Adnan Mohammed Ahmed Al Menhali, Khalid Abdul Menem Saif Al Kindi, Ergun Kuru, Ferda Akgun, "Optimization of Drilling Operational Parameters and UBD Feasibility Study in a Mature UAE Field Wells", SPE 118082-MS-P, Abu Dhabi International Petroleum Exhibition and Conference, Nov. 3-6, 2008, Abu Dhabi, UAE.

(Continued)

*Primary Examiner* — Robert E Fuller
*Assistant Examiner* — Steven MacDonald
(74) *Attorney, Agent, or Firm* — Kenneth L. Kincaid

(57) ABSTRACT

Methods and apparatus for positioning a downhole tool in a wellbore extending into a subterranean formation, commencing coring operations by rotating a coring bit of the downhole tool and extending the rotating coring bit into a sidewall of the wellbore, sensing a parameter associated with the coring operations, and adjusting the coring operations based on the sensed parameter.

6 Claims, 8 Drawing Sheets

(56) References Cited

U.S. PATENT DOCUMENTS

| | | | | |
|---|---|---|---|---|
| 5,667,025 | A | 9/1997 | Haessly et al. | |
| 5,959,547 | A * | 9/1999 | Tubel et al. | 340/853.2 |
| 6,186,248 | B1 * | 2/2001 | Silay et al. | 175/27 |
| 6,371,221 | B1 | 4/2002 | Harrigan et al. | |
| 7,191,831 | B2 | 3/2007 | Reid et al. | |
| 7,293,715 | B2 | 11/2007 | Bargach | |
| 7,530,407 | B2 | 5/2009 | Tchakarov et al. | |
| 7,673,704 | B2 * | 3/2010 | Phan et al. | 175/20 |
| 2009/0090555 | A1 * | 4/2009 | Boone et al. | 175/45 |
| 2009/0114447 | A1 | 5/2009 | Reid, Jr. et al. | |
| 2009/0133932 | A1 * | 5/2009 | Church | 175/44 |
| 2009/0173539 | A1 | 7/2009 | Mock et al. | |
| 2012/0152011 | A1 * | 6/2012 | Zamora et al. | 73/152.03 |

OTHER PUBLICATIONS

PCT International Preliminary Report on Patentability of PCT/US2010/051926 dated Apr. 11, 2012.

Office Action for Mexican Application No. MX/a/2012/004220 dated Jan. 15, 2015.

Office Action issued Jul. 29, 2015 in corresponding Mexican Patent Application No. MX/a/2012/004220 with agent's English translation included; 12 pages.

* cited by examiner

AUTOMATED SIDEWALL CORING

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Some formation evaluation operations may include extracting one or more core samples from a sidewall of the borehole. Such core samples may be extracted using a coring assembly or tool that is part of a downhole tool, which may be conveyed via a wireline, drillstring, or in any other manner. Typically, multiple core samples are extracted from multiple locations along the borehole and stored in the downhole tool. The stored core samples may then be retrieved at the surface when the downhole tool is removed from the borehole and tested or otherwise evaluated to assess the locations corresponding to the core samples.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
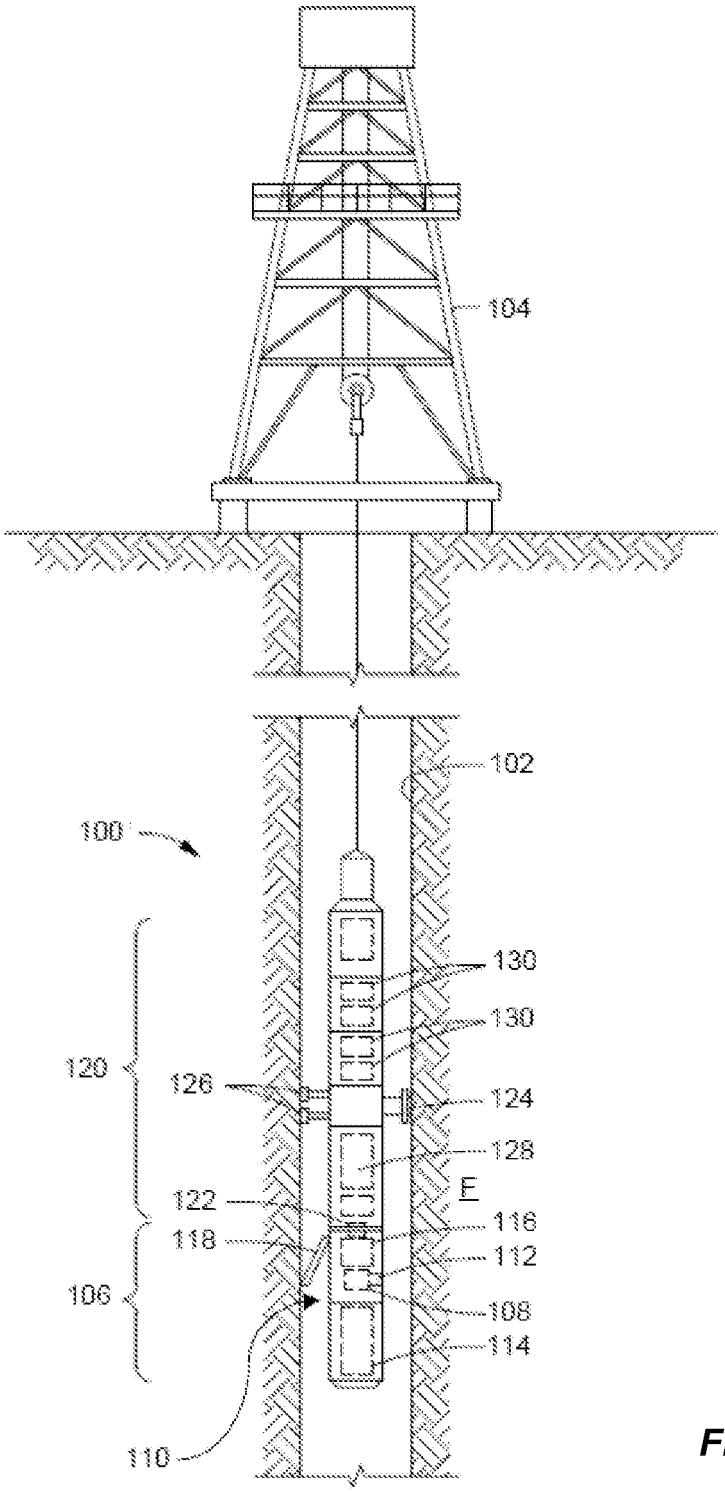
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

By implementing a full feedback drill algorithm based on measured drilling parameters in a coring tool, the task of cutting cores may be made to react to the type of rock being cut. This may increase efficiency in terms of system power used and the duration it takes to cut a core. This increased efficiency is important in recent coring tools in which the core volume being cut may be dramatically increased from previous coring tools.

In addition, the mechanical energy dissipated when advancing the coring bit is related to properties of the formation (e.g., a compressive strength of the formation rock). Thus, valuable information about the formation may be extracted from measured drilling parameters.

The present disclosure introduces a coring tool having a bit rotating speed ("BRS") sensor, a torque at bit ("TAB") sensor, a weight on bit ("WOB") sensor, and a bit rate of penetration ("ROP") sensor. These measurements may be transmitted to a surface operator while a coring operation is taking place and may be used to monitor the operation. These measurements may further be processed to extract formation properties, such as a compressive strength. Such processing may be performed by a controller downhole, such that the downhole coring tool may automatically adjust to the formation and coring conditions.

The coring tool of the present disclosure may also comprise a bit rotation motor, configured to rotate the coring bit, and a controller (e.g., a downhole controller), configured to control the rotating speed of the bit rotation motor. The controller may be configured to, for example, set a high rotating speed in consolidated formations and a low rotating speed in unconsolidated formations. The detection of the formation characteristics (consolidated versus unconsolidated) may be performed using one or more of a TAB measurement, a ROP measurement, and a WOB measurement. Such detection may also be performed automatically, by the downhole controller or otherwise.

The coring tool of the present disclosure may also comprise a WOB motor, configured to extend the coring bit into the formation, and a controller (e.g., the same downhole controller), configured to control the rotating speed of WOB motor, such as for expediting the coring operation while preventing stalling of the bit rotation motor. The controller may be configured to, for example, set the rotating speed of WOB motor so that the TAB measurement is maintained below a stalling torque value.

Example coring tools and methods that may employ aspects of the example methods and apparatus described herein are described in U.S. Pat. No. 7,293,715, entitled "Marking System and Method," and issued on Nov. 13, 2007; U.S. Patent Application Publication No. 2009/0114447, entitled "Coring Tool and Method," and published on May 7, 2009; U.S. Pat. No. 4,714,449, entitled "Apparatus for Hard Rock Sidewall Coring a Borehole," and issued on Dec. 22, 1987; U.S. Pat. No. 5,667,025, entitled "Articulated Bit-Selector Coring Tool," and issued on Sep. 16, 1997; and U.S. Pat. No. 7,191,831, entitled "Downhole Formation Testing Tool," and issued on Mar. 20, 2007; each of which is assigned to the assignee of the present application.

While the example apparatus and methods described herein are described in the context of wireline tools, they are also applicable to any number and/or type(s) of additional and/or alternative downhole tools such as drillstring and coiled tubing deployed tools.

FIG. 1 is a schematic illustration of a wireline downhole tool or toolstring 100 deployed in a borehole 102 and suspended from a rig 104 according to one or more aspects of the present disclosure. The toolstring 100 includes a core sampling assembly 106 having a coring tool assembly 108, which includes a coring bit assembly 110 having a coring bit 112. The core sampling assembly 106 further includes a storage location or area 114 for storing core samples, and associated actuation mechanisms 116. The storage location or area 114 is configured to receive sample cores, which may be disposed in a sleeve, canister or, more generally, a sample container or other sample holder. At least one brace arm 118 may be provided to stabilize the toolstring 100 in the borehole 102 while the coring bit 112 is extracting a core sample.

The toolstring 100 may further include additional systems for performing other functions. One such additional system is illustrated in FIG. 1 as a formation testing tool 120 that is operatively coupled to the core sampling assembly 106 via a field joint 122. The formation testing tool 120 may include a probe 124 that is extended from the formation testing tool 120 to be in fluid communication with a formation F. Back up pistons 126 may be included in the toolstring 100 to assist in pushing the probe 124 into contact with the sidewall of the borehole 102 and to stabilize the toolstring 100 in the borehole 102.

The formation testing tool 120 shown in FIG. 1 also includes a pump 128 for pumping sample fluid, as well as sample chambers 130 for storing fluid samples. The locations of these components are only schematically shown in FIG. 1 and, thus, may be provided in locations within the toolstring 100 other than those illustrated. Other components, such as a power module, a hydraulic module, a fluid analyzer module, and other devices, may also be included.

The example apparatus of FIG. 1 is depicted as having multiple modules operatively connected together. However, the example apparatus may also be partially or completely unitary. For example, the formation testing tool 120 may be unitary, with the core sampling assembly 106 housed in a separate module operatively connected by the field joint 122. Alternatively, the core sampling assembly 106 may be unitarily included within the overall housing of the toolstring 100.

Figure 2:
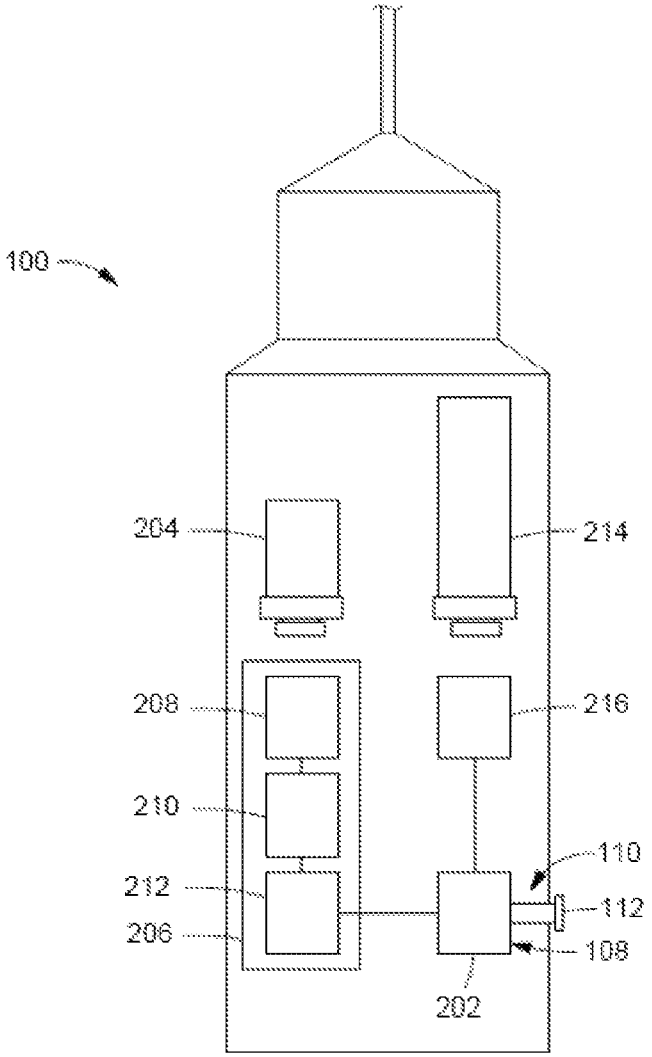
FIG. 2 is a schematic view of apparatus according to one or more aspects of the present disclosure.

FIG. 2 is an enlarged schematic illustration of the core sampling assembly 106 of FIG. 1 according to one or more aspects of the present disclosure. As noted above, the core sampling assembly 106 includes the coring assembly 108 with the coring bit 112. A hydraulic coring motor 202 is operatively coupled to rotationally drive the coring bit 112 to cut into the formation F and obtain a core sample.

To drive the coring bit 121 into the formation F, the coring bit 121 is pressed into the formation F while the bit 112 rotates. Thus, the core sampling assembly 106 applies a weight-on-bit (WOB), which is a force that presses the coring bit 112 into the formation F, and a torque to the coring bit 112. FIG. 2 schematically depicts mechanisms for applying both of these forces. For example, the WOB may be generated by a motor 204, which may be an alternating current (AC), brushless direct current (DC), or other power source, and a control assembly 206. The control assembly 206 may include a hydraulic pump 208, a feedback flow control ("FFC") valve 210, and a piston 212 (also referred to herein as the "kinematics piston"). The motor 204 supplies power to the hydraulic pump 208, while the flow of hydraulic fluid from the pump 208 is regulated by the FFC valve 210. The pressure of the hydraulic fluid drives the piston 212 to apply a WOB to the coring bit 112.

Torque may be supplied to the coring bit 112 by a second motor 214, which may be an AC, brushless DC, or other power source, and a gear pump 216. The second motor 214 drives the gear pump 216, which supplies a flow of hydraulic fluid to the hydraulic coring motor 202. The hydraulic coring motor 202, in turn, imparts a torque to the coring bit 112 that causes the coring bit 112 to rotate.

While specific examples of the mechanisms for applying WOB and torque are provided above, any known mechanisms for generating such forces may be used without departing from the scope of the present disclosure. Additional examples of mechanisms that may be used to apply WOB and torque are disclosed in U.S. Pat. Nos. 6,371,221 and 7,191,831, both of which are assigned to the assignee of the present application.

Figure 3:
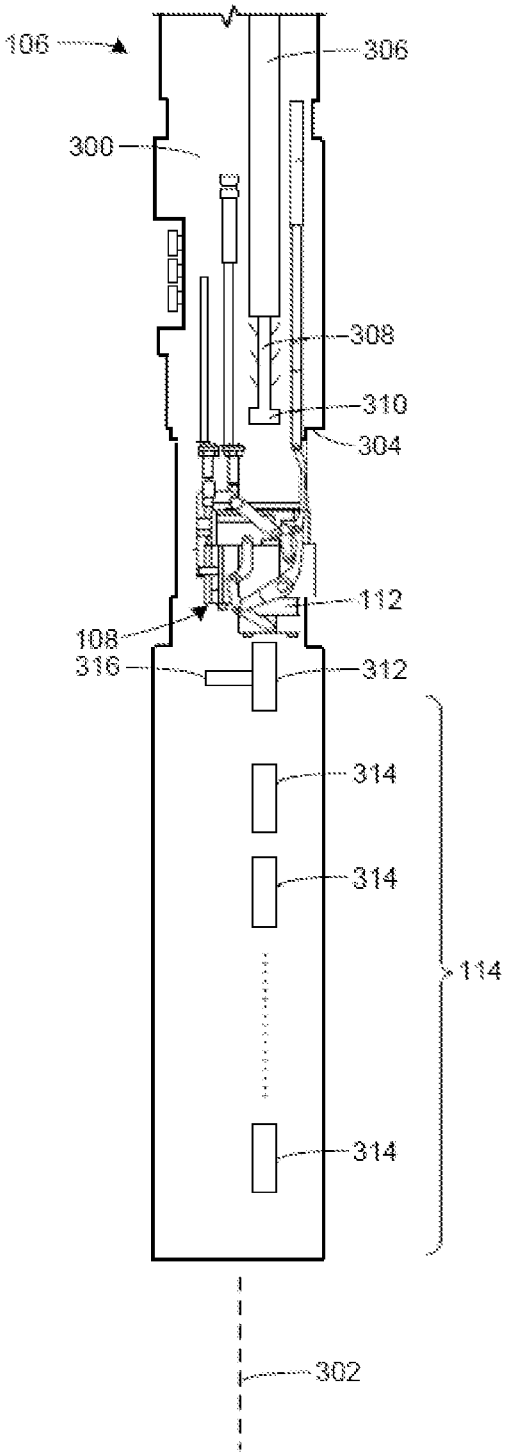
FIG. 3 is a schematic view of apparatus according to one or more aspects of the present disclosure.

FIG. 3 is a more detailed schematic diagram of the core sampling assembly 106 of FIGS. 1 and 2 according to one or more aspects of the present disclosure. The core sampling assembly 106 includes a tool body or housing 300 having a longitudinal axis 302. The tool housing 300 defines a coring aperture 304 through which core samples are retrieved via the coring tool assembly 108. The coring tool assembly 108 is coupled to the tool housing 300 to enable the coring tool assembly 108 to rotate and extend the coring bit 112 through the coring aperture 304 of the tool housing 300 and into contact with a formation from which a core sample is to be extracted.

In operation, a handling piston 306 extends a gripper brush 308 having a foot or head 310 through the coring tool assembly 108, a core transfer tube 312 and into the storage area 114. The storage area 114 may contain a plurality core sample containers 314, some of which may be empty and others of which may have core samples stored therein. Thus, the foot 310 and gripper brush 308 may extend into an opening of an empty core sample container 314 to couple the sample container 314 to the handling piston 306. The handling piston 306 is then retracted to move the empty sample container 314 into the core transfer tube 312. A sample container retainer 316 coupled to the core transfer tube 312 may then be engaged to firmly hold the empty sample container 314 within the core transfer tube 312. While the empty sample container 314 is held by the sample container retainer 316 within the core transfer tube 312, the handling piston 306 is further retracted out of engagement with the empty sample container 314, through the coring tool assembly 108 and returned to the position depicted in FIG. 3.

The coring tool assembly 108 is then rotated and translated through the coring aperture 304 to engage the coring bit 112 with the location of the formation from which a core sample is to be extracted. Once the coring bit 112 has extracted a core sample, the coring tool assembly 108 rotates back into the position shown in FIG. 3 and the handling piston 306 is again extended so that the foot 310 moves or pushes the core sample out of the coring tool assembly 108 and into the sample container 314 held in the core transfer tube 312. Once the core sample has been deposited in the core sample container 314 held in the core transfer tube 312, a force applied by the sample container retainer 316 to the sample container therein may be reduced to continue to frictionally engage and hold the sample container 314, but allow movement of the sample container 314 relative to the sample container retainer 316 in response to force applied by the handling piston 306. Additionally, this reduced force enables the handling piston 306 to continue to move the sample container 314 toward the storage area 114 without causing damage to the core sample held within the sample container 314 and without causing any substantial damage to the sample container 314.

Figures 4, 5:
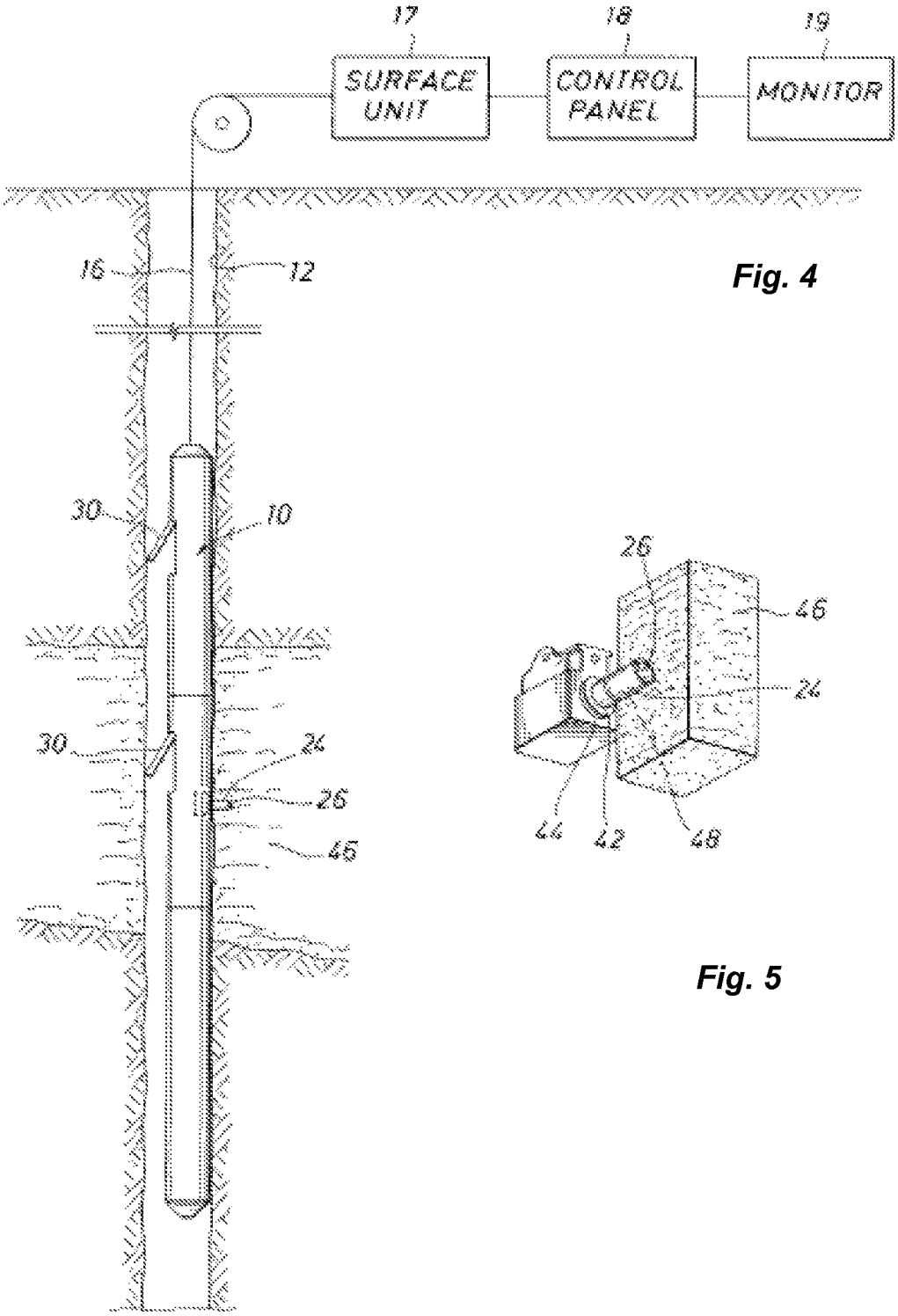
FIG. 4 is a schematic view of apparatus according to one or more aspects of the present disclosure.
FIG. 5 is a schematic view of apparatus according to one or more aspects of the present disclosure.

FIG. 4 shows the general features of a coring tool in use in a drilled well for coring a downhole geologic formation according to one or more aspects of the present disclosure. One or more aspects of the apparatus shown in FIG. 4 may be substantially similar or identical to those of apparatus shown in FIGS. 1-3.

The coring tool 10 is lowered into the bore hole defined by the bore wall 12, often referred to as the side wall. The coring tool 10 is connected by one or more electrically conducting cables 16 to a surface unit 17 that typically includes a control panel 18 and a monitor 19. The surface unit is designed to provide electric power to the coring tool 10, to monitor the status of downhole coring and activities of other downhole equipment, and to control the activities of the coring tool 10 and other downhole equipment. The coring tool 10 is generally contained within an elongate housing suitable for being lowered into and retrieved from the bore hole. The coring tool 10 contains a coring assembly generally comprising one or more motors 44 powered through the cables 16, a coring bit 24 having a distal, open end 26 for cutting and receiving the core sample, and a mechanical linkage for deploying and retracting the coring bit from and to the coring tool 10 and for rotating the coring bit against the side wall. FIG. 4 shows the core tool 10 in its active, cutting configuration. The coring tool 10 is positioned adjacent to the target geologic formation 46 and secured firmly against the side wall 12 using anchoring arms or shoes 28 and 30 extended from the opposing side of the coring tool from the coring bit. The distal, open end 26 of the coring bit 24 is rotated against the target geologic formation to cut the core sample.

FIG. 5 shows a perspective view of the coring bit 24 after it has cut into the target geologic formation 46. The coring bit 24 is fixedly connected to a base 42 which is, in turn, connected to and turned by a coring motor 44. The core sample 48 is received into the hollow interior of the coring bit 24 as cutting progresses. As described above, the coring bit is preferably actuated by two independent motors, a coring motor configured to rotate/apply a torque to the coring bit, and a kinematics motor configured to extend/apply a weight (WOB) on the coring bit.

While FIGS. 4 and 5 show the coring tool deployed at the end of a wireline cable, a coring tool within the scope of the present disclosure may be deployed in a well using any known or future-developed conveyance means, including drill pipe, coiled tubing, etc. For example, the coring tool motors may be powered via a downhole mud driven alternator.

Figure 6:
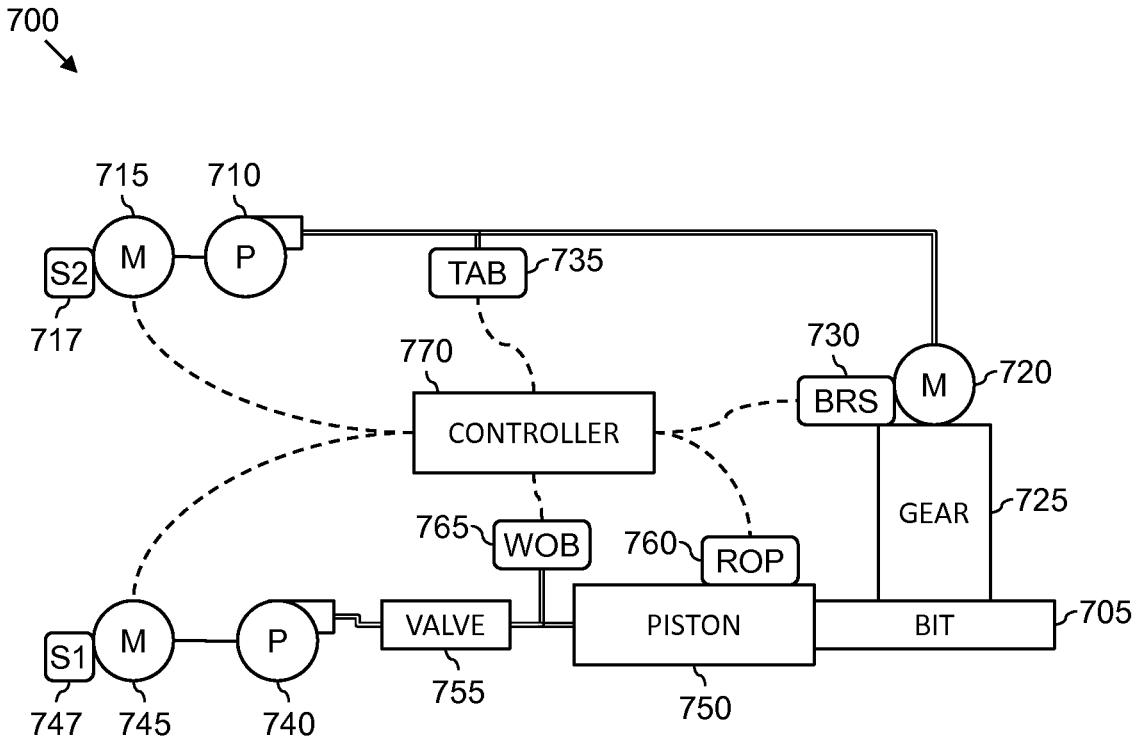
FIG. 6 is a schematic view of apparatus according to one or more aspects of the present disclosure.

FIG. 6 is a schematic view of an actuation system 700 configured to drive a coring bit 705 according to one or more aspects of the present disclosure. The actuation system 700 is for use with, and/or a part of, the apparatus shown in FIGS. 1-5.

A hydraulic pump 710, actuated by a bit rotation motor 715 (e.g., a brushless DC motor), provides hydraulic fluid to a hydraulic motor 720. The bit rotation motor 715 may include a resolver configured to measure the rotor position. Thus, the rotating speed S2 of the bit rotation motor 715 may be measured by the resolver and/or another component, schematically depicted in FIG. 6 by S2 sensor 717. The output shaft of hydraulic motor 720 engages a gear 725 which rotationally drives the coring bit 705.

The actuation system 700 also includes a BRS sensor 730. For example, the rotating speed of the shaft of the hydraulic motor 720 may be monitored using a tachometer, such as may include a Hall effect sensor and a magnet coupled to the shaft. The rotating speed of the shaft is equal (or proportional) to the bit rotating speed (BRS). In cases where a direct drive (not shown) between the bit rotation motor 715 and the coring bit 705 is used instead of the hydraulic pump 710 and motor 720, the bit rotating speed may also be determined from the rotating speed S1 of the bit rotation motor 715 (e.g., from data received from speed sensor 717).

The actuation system 700 also includes a TAB sensor 735. For example, the pressure in the hydraulic circuit driving the hydraulic motor 720 may be measured using a pressure gauge to indicate the TAB (proper computations known in the art may be performed to compute the TAB from the pressure). In cases where the hydraulic motor 720 is used (as shown), the ratio of the BRS and the speed S2 of the bit rotation motor 715 may also be used to determine the TAB. In cases where a direct drive (not shown) between the bit rotation motor 715 and the coring bit 705 is used instead of the hydraulic pump 710 and motor 720, the TAB may be determined from a current level driving the bit rotation motor 715 if the motor is a DC motor, or from a phase shift if the motor is an AC motor.

A hydraulic pump 740, actuated by a WOB motor 745 (e.g., a brushless DC motor) provides hydraulic fluid to a kinematics piston 750. The WOB motor 745 may include a resolver configured to measure the rotor position. Thus, the rotating speed S1 of the WOB motor 745 may be measured by the resolver and/or another component, schematically depicted in FIG. 6 by S1 sensor 747. An accumulator (not shown) configured to store hydraulic fluid may be provided between the hydraulic pump 740 and a valve 755, for damping the pressure response of the hydraulic circuit between the pump 740 and the kinematics piston 750.

The actuation system 700 also includes a ROP sensor 760. For example, the extension of the kinematics piston 750 may be monitored using a linear potentiometer to indicate the coring bit ROP (proper computations known in the art may be performed to compute the bit ROP from the voltage reading). In cases where the hydraulic pump 740 is used (as shown), a flow rate sensor disposed in the hydraulic circuit driving the piston 750 may alternatively be used to determine the bit ROP. In cases where a direct drive (not shown) between the WOB motor 745 and the kinematics piston 750 is used instead of the hydraulic pump 740, a motor turn counter (e.g., a resolver) may be used to determine the bit ROP.

The actuation system 700 also includes a WOB sensor 765. For example, the pressure in the hydraulic circuit driving the kinematics piston 750 may be measured using a pressure gauge to indicate the WOB (proper computations known in the art may be performed to compute the WOB from the pressure). In cases where a direct drive (not shown) between the WOB motor 745 and kinematics piston 750 is used instead of the hydraulic pump 740, the WOB may be measured using a current sensor configured to measure the current flowing in the WOB motor 745 if the WOB motor is a DC motor, or from a phase shift if the WOB motor is an AC motor.

These measurements discussed above may be transmitted to a surface operator while a coring operation is taking place and may be used to monitor the operation. In addition, an estimate of a formation compressive strength σ may be provided using the formula:

$$\sigma = \frac{ROP \cdot WOB + 120\pi BRS \cdot TAB}{A \cdot ROP}$$

where A is the area of the cutting bit. The formula may also be approximated in some cases as:

$$\sigma = \frac{120\pi BRS \cdot TAB}{A \cdot ROP}$$

Some of these measurements (BRS, TAB, ROP, WOB and combinations) may be communicated with a controller 770 of the downhole tool. The controller 770 may be configured to control the bit rotation motor 715 and/or the WOB motor 745, such as to set the target speed of the bit rotation motor 715 and/or the WOB motor 745 based on these measurements. The controller 770 may also be configured to pilot solenoid valves (not shown) configured to control the direction of the kinematics piston 750. While particular examples of sensor implementation are shown in FIG. 6, other implementations are also possible, such as previously discussed.

Figure 7:
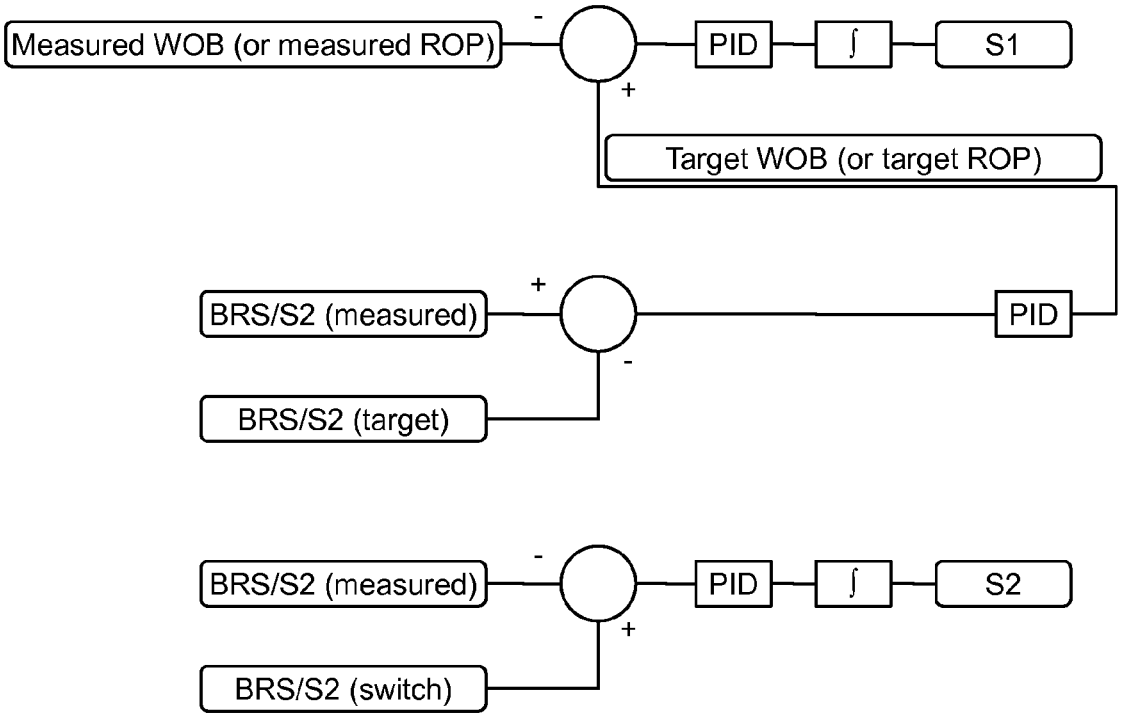
FIG. 7 is a schematic view of apparatus according to one or more aspects of the present disclosure.

FIG. 7 is a schematic view of a control algorithm according to one or more aspects of the present disclosure, which may be implemented by the apparatus shown in FIGS. 1-6. Referring to FIGS. 6 and 7, collectively, the desired or target speed S2 of the bit rotation motor 715 and/or the desired or target speed S1 of the WOB motor 745 may be set based on the ratio of the BRS (as measured by the BRS sensor 730) to the rotating speed S2 of the bit rotation motor 715. This ratio is indicative of the TAB. It should be appreciated that the pressure data provided by a pressure gauge (e.g., the TAB sensor 735), among other measurements, may alternatively be used to monitor the TAB.

In the control algorithm of FIG. 7, the controller 770 is configured to control the rotating speed S1 of the WOB motor 745 to achieve a target ratio of BRS to the speed S2 of the bit rotation motor 715 (that is, essentially, a target torque). The target ratio may correspond to a high TAB value that can be achieved with the hardware, but that is nevertheless lower than a stalling TAB value. For example, when the measured ratio is higher than the target ratio (that is, essentially, a measured torque lower than a target torque), the controller 770 may increase a target WOB (or a target ROP) by, for example, using a proportional integral derivative or "PID" algorithm. Then, when the target WOB (or the target ROP) is higher than the measured WOB (or respectively the measured ROP), the controller 770 may increase the rotating speed S1 of the WOB motor 745, thereby increasing the extension of the kinematics piston 750. It should be appreciated that the shown cascaded PID (2 PIDs) is optional.

The control algorithm illustrated in FIG. 7 has been found to expedite the coring operations while preventing stalling of the bit rotation motor 715. Indeed, it has been found that in consolidated formations, the algorithm will maintain the measured ratio of BRS to the speed S2 of the bit rotation motor 715 (that is, essentially, a measured torque) close to the target ratio, thereby preventing stalling of the bit rotation motor 715. Also, it has been found that in unconsolidated formations, the measured ratio is usually higher than the target ratio (that is, the torque remains below the target torque). Thus, the algorithm executed by the controller 770 may cause the rotating speed S1 of the WOB motor 745 to increase (until a limit is reached), thereby expediting the coring operations.

In the control algorithm of FIG. 7, the controller 770 is configured to control the rotating speed S2 of the bit rotation motor 715 so that the BRS is high in consolidated formations and low in unconsolidated formations. For example, in unconsolidated formations, the measured ratio of BRS to the speed S2 of the bit rotation motor 715 (that is, essentially, a measured torque) is usually higher than the target ratio. If the measured ratio of BRS to the speed S2 of the bit rotation motor 715 is above a switch value (larger than the target value), the algorithm executed by the controller 770 causes the rotating speed S2 of the bit rotation motor 715 to decrease (until a limit is reached), thereby decreasing the BRS. Conversely, the measured ratio of BRS to the speed S2 of the bit rotation motor 715 is usually close to the target value in consolidated formations, and thus, is lower than the switch value. In this case, the algorithm executed by the controller 770 causes the rotating speed S2 of the bit rotation motor 715 to increase (until a limit is reached), thereby increasing the BRS.

In addition to the two control loops shown in FIG. 7, the controller 770 may also be configured to control valves (e.g., solenoids) that control the direction of the kinematics piston 750. For example, the controller 770 may be configured to retract the kinematics piston 750 (and/or disable the accumulator) if the hydraulic pressure (e.g., measured by the TAB sensor 735), which is indicative of the TAB, is too high, which may indicate that the bit is stalling. Additionally, or alternatively, the controller 770 may be configured to retract the kinematics piston 750 (and/or disable the accumulator) if the BRS measured by the BRS sensor 730 is too low, which may also indicate that the bit is stalling. The controller 770 may be further configured to resume the extension of the kinematics piston 750 (and/or enable the accumulator) if the hydraulic pressure (e.g., measured by the TAB sensor 735), which is indicative of the TAB, and/or the BRS measured by the BRS sensor 730 have recovered values within an acceptable operating range.

It should be appreciated that the PID controllers schematically shown in FIG. 7 may be implemented within or by the controller 770 shown in FIG. 6. It should be further appreciated that while PID controllers are shown in FIG. 7, other controller types, such as PI (proportional integral) controllers for example, may alternatively be used.

Figure 8:
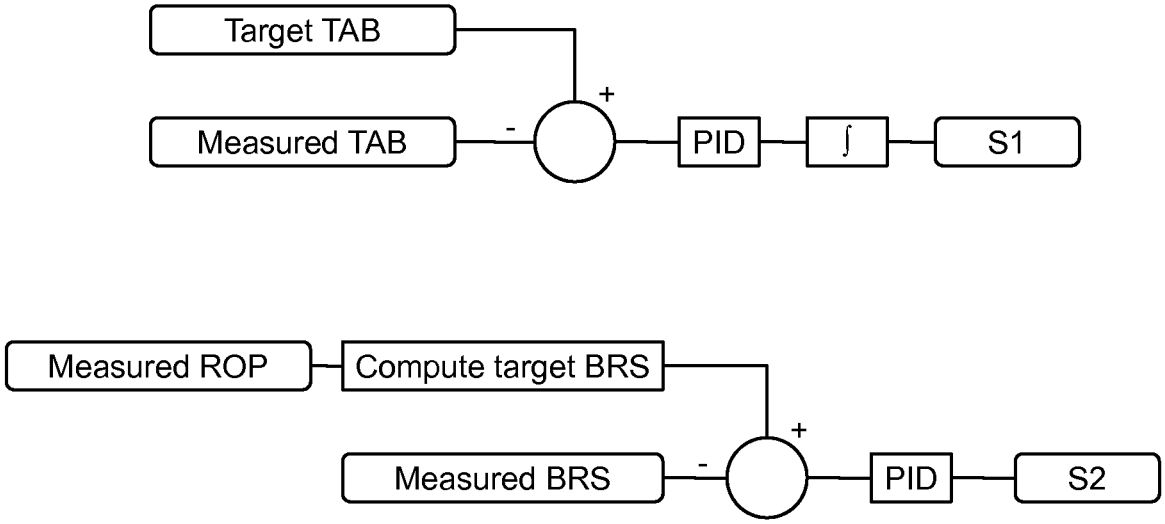
FIG. 8 is a schematic view of apparatus according to one or more aspects of the present disclosure.

FIG. 8 is a schematic view of a control algorithm according to one or more aspects of the present disclosure, which may be implemented by the apparatus shown in FIGS. 1-6. Referring to FIGS. 6 and 8, collectively, the controller 770 may alternatively be configured to set targets for BRS determined based on the measured ROP. For example, the target value for the BRS may be determined as a predetermined decreasing function g of the measured ROP. The function g involves threshold values to maintain the BRS within hardware limits.

$$BRS_{target} = g(ROP)$$

The function g may be determined experimentally by measuring efficient BRS as a function of the ROP on a test material while maintaining the power limitation of the coring tool. A BRS may be deemed "efficient" if good quality cores are drilled (e.g., limited washout of the core, no fractures on the core, etc.) and the coring bit is not balling. Indeed, when drilling, a drill generates a chip at the contact area between the drill bit and the material being drilled (i.e., the formation). The chip is then removed from the contact area between the drill bit and the material being drilled. An efficient BRS may insure that the rate at which the chips are generated ("Generation Rate" or "GR") is larger than the rate at which the chips are removed from the contact ("Removal Rate" or "RR").

In the control algorithm of FIG. 8, the controller 770 is configured to control the rotating speed S1 of the WOB motor 745 to achieve a target TAB. The control algorithm of the rotating speed S1 may be similar to its counterpart shown in FIG. 7, although implemented differently (e.g., different input measurement and different feedback loop).

As shown in FIG. 8, the controller 770 may be configured to actuate the bit rotation motor 715 to achieve the computed target value of BRS using a feedback control loop fed to the bit rotation motor 715. For example, the feedback control loop may be implemented using a PID algorithm, well known in the art. Indeed, for a given TAB utilized for drilling (the target TAB in FIG. 8), the ROP may be indicative of the formation consolidation (e.g., formation compressive strength, hardness, etc.) and, to some extent, of the drilling efficiency. Thus, if the ROP is high (unconsolidated formation and/or no accumulation of chips in front of the cutting bit), the controller 770 may set a low BRS. Conversely, if ROP is low (consolidated formation and/or accumulation of chips in front of the cutting bit), the controller 770 may set a high BRS.

The algorithm shown in FIG. 8 shows control of BRS based on a predetermined function g of the measured ROP. However, the WOB may also be controlled based on another predetermined function of the ROP instead of a target torque pressure.

It should be appreciated that the PID controllers schematically shown in FIG. 8 may be implemented within or by the controller 770 shown in FIG. 6. It should be further appreciated that while PID controllers are shown in FIG. 8, other controller types, such as PI (proportional integral) controllers for example, may alternatively be used.

Figure 9:
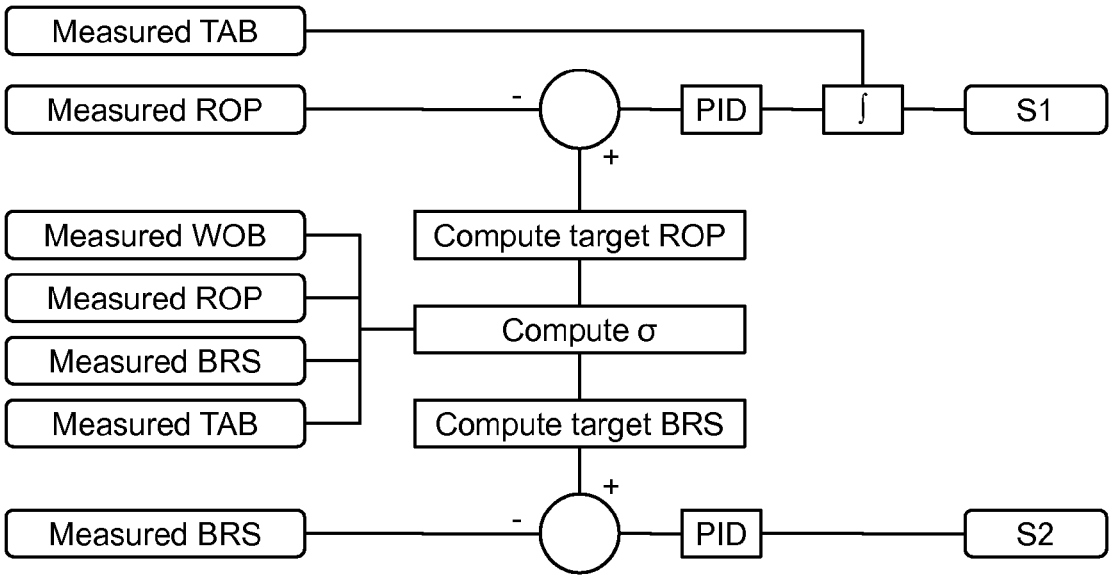
FIG. 9 is a schematic view of apparatus according to one or more aspects of the present disclosure.

FIG. 9 is a schematic view of a control algorithm according to one or more aspects of the present disclosure, which may be implemented by the apparatus shown in FIGS. 1-6. Referring to FIGS. 6 and 9, collectively, the controller 770 may be configured to set targets for BRS to achieve a target ROP determined based on the measured ROP, the measured WOB, the measured TAB, and the measured BRS. For example, the controller 770 may be configured to compute an apparent rock strength or type σ computed using, for example, the formula previously discussed, (or its approximation):

$$\sigma = \frac{ROP \cdot WOB + 120\pi BRS \cdot TAB}{A \cdot ROP}$$

Then, the controller 770 may determine the target value of the BRS as a predetermined increasing function h of the determined apparent rock strength or type σ. The controller 770 may be configured to set a large target BRS in consolidated formations (that is, corresponding to a high value of rock strength or type σ) and a small target BRS in unconsolidated formations (that is, corresponding to a low value of rock strength or type σ). The function h involves threshold values to maintain the BRS within hardware limits.

$$BRS_{target} = h(\sigma)$$

The function $f$ may be determined experimentally by measuring efficient BRS as a function of the apparent rock strength or type σ on a test material while maintaining the power limitation of the coring tool. Then the target value for the ROP may be determined as a predetermined decreasing function $f$ of the determined apparent rock strength or type σ. The controller 770 may be configured to set a small target ROP in consolidated formations (that is, corresponding to a high value of rock strength or type σ) and a large target ROP in unconsolidated formations (that is, corresponding to a low value of rock strength or type σ). The function $f$ involves threshold values to maintain the ROP within hardware limits.

$$ROP_{target} = f(\sigma)$$

The function $f$ may be determined experimentally by measuring efficient ROP as a function of the apparent rock strength or type σ on a test material while maintaining the power limitation of the coring tool.

The controller 770 may control the rotating speed S1 of the WOB motor 745 to achieve the target ROP computed above, for example using a PID algorithm. However, a limiter may be used to limit or lower the rotating speed S1 of the WOB motor 745 when the torque pressure reaches a level at which the bit rotation motor 715 may stall.

The controller 770 may control the rotating speed S2 of the bit rotation motor 715 to achieve the target BRS computed above, for example using a PID algorithm.

It should be appreciated that the PID controllers schematically shown in FIG. 9 may be implemented within or by the controller 770 shown in FIG. 6. It should be further appreciated that while PID controllers are shown in FIG. 9, other controller types, such as PI (proportional integral) controllers for example, may alternatively be used.

Current commercial coring tools may obtain 1.4 $in^3$ cores in about 5 minutes. The automated coring algorithms based on the measurements described herein may be able to cut 5.3 $in^3$ cores in less than 5 minutes.

The automated coring algorithms may be configured to allow the downhole or surface controller to adapt to the BRS "on the fly" as coring progresses at one coring station. This may be useful when no a priori knowledge of the formation characteristic is available. This may also be useful when the characteristics of the formation and/or bit wear level changes as coring proceeds and/or formation cuttings accumulate near the bit.

Setting a high BRS in consolidated formations and a low BRS in unconsolidated formations has been found in laboratory experiments to improve the quality of the cores. Expediting the coring operations has also been found in laboratory experiments to improve the quality of the cores obtained from an unconsolidated formation. Feedback control configured to prevent the bit rotation motor to stall has also been found to be a robust method of obtaining a core in consolidated formations. One or more apparatus and/or methods within the scope of the present disclosure may enable one or more of such advantages.

In view of all of the above and the figures, those skilled in the art should readily recognize that the present disclosure introduces a method comprising: positioning a downhole tool in a wellbore extending into a subterranean formation; commencing coring operations by rotating a coring bit of the downhole tool and extending the rotating coring bit into a sidewall of the wellbore; sensing a parameter associated with the coring operations; and adjusting the coring operations based on the sensed parameter. The sensed parameter may be rotating speed of the coring bit. The sensed parameter may be torque at the coring bit. The sensed parameter may be "weight on bit" of the coring bit. The sensed parameter may be rate of penetration of the coring bit into the formation. Sensing the parameter may comprise sensing a plurality of parameters including rotating speed of the coring bit, torque at the coring bit, "weight on bit" of the coring bit, and rate of penetration of the coring bit into the formation. Commencing coring operations may comprise operating a motor configured to rotate the coring bit, and adjusting the coring operations may comprise adjusting an operational parameter of the motor. Commencing coring operations may comprise operating a pump configured to rotate the coring bit, and adjusting the coring operations may comprise adjusting an operational parameter of the pump. Commencing coring operations may comprise operating a motor configured to extend the coring bit, and adjusting the coring operations may comprise adjusting an operational parameter of the motor. Commencing coring operations may comprise operating a pump configured to extend the coring bit, and adjusting the coring operations may comprise adjusting an operational parameter of the pump. The sensed parameter may be indicative of the degree of consolidation of the formation. The method may further comprise determining a compressive strength of the formation based on the sensed parameter, and adjusting the coring operations may be further based on the determined compressive strength of the formation.

The present disclosure also introduces an apparatus comprising: a downhole tool configured for conveyance within a borehole extending into a subterranean formation, wherein the downhole tool comprises: a first hydraulic pump driven by a first motor; a hydraulic motor driven by the first hydraulic pump; a coring bit rotationally driven by the hydraulic motor; a second hydraulic pump driven by a second motor; an actuator linearly driven by hydraulic fluid received from the second hydraulic pump and configured to extend the coring bit from the downhole tool; a plurality of sensors configured to sense coring operation parameters; and a controller configured to drive the first motor at a first rotating speed when data from one or more of the plurality of sensors indicate coring is occurring in a consolidated formation and at a second rotating speed when data from one or more of the plurality of sensors indicate coring is occurring in an unconsolidated formation, wherein the first rotating speed is substantially greater than the second rotating speed. The plurality of sensors may comprise a torque at bit (TAB) sensor, a rate of penetration (ROP) sensor, and a weight on bit (WOB) sensor, and the controller may be configured to drive the first motor based on data from each of the TAB sensor, the ROP sensor, and the WOB sensor. The controller may be further configured to drive the second motor at a maximum speed which does not cause the first motor to stall. The plurality of sensors may comprise a torque at bit (TAB) sensor, and the controller may be further configured to drive the second motor at a maximum speed which does not cause the torque sensed by the TAB sensor to exceed a stalling torque value. The plurality of sensors may comprise a bit rotating speed (BRS) sensor, a torque at bit (TAB) sensor, a weight on bit (WOB) sensor, and a rate of penetration (ROP) sensor, and the controller may comprise a proportional integral derivative controller configured to drive the speed of the second motor based on: data from the WOB sensor or the ROP sensor; a target WOB or a target ROP; a ratio of data from the BRS sensor and data from a first motor speed sensor; and a target ratio of BRS to speed of the second motor. The controller may be further configured to drive the speed of the first motor based on: a ratio of data from the BRS sensor and data from a first motor speed sensor; and a ratio of BRS to speed of the second motor which is greater than a target ratio of BRS to speed of the second motor. The plurality of sensors may comprise a bit rotating speed (BRS) sensor, a torque at bit (TAB) sensor, a weight on bit (WOB) sensor, and a rate of penetration (ROP) sensor, and the controller may comprise a proportional integral derivative controller configured to: drive the speed of the second motor based on data from the TAB and a target TAB; and drive the speed of the first motor based on data from the ROP sensor, data from the BRS sensor, and a target BRS computed based on data from the ROP sensor. The plurality of sensors may comprise a bit rotating speed (BRS) sensor, a torque at bit (TAB) sensor, a weight on bit (WOB) sensor, and a rate of penetration (ROP) sensor, and the controller may comprise a proportional integral derivative controller configured to drive the speed of the first and second motors based on: data from each of the BRS, TAB, WOB, and ROP sensors; a target ROP computed by the controller; a formation characteristic computed by the controller; and a target BRS computed by the controller.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

positioning a downhole tool in a wellbore extending into a subterranean formation;

commencing coring operations by rotating a coring bit of the downhole tool and extending the rotating coring bit into a sidewall of the wellbore;

measuring a rotating speed of the coring bit using a bit rotating speed sensor;

measuring a rotating speed of a bit rotation motor using a bit rotation motor speed sensor;

computing via a controller a ratio of the measured rotating speed of the coring to the measured rotating speed of the bit rotation motor;

comparing via the controller the computed ratio to a target ratio of the measured rotating speed of the coring to the measured rotating speed of the bit rotation motor; and automatically adjusting via the controller a rotating speed of a weight on bit (WOB) motor based on the comparison of the computed ratio to the target ratio.

2. The method of claim 1 further comprising determining a compressive strength of the formation based on the measured rotating speed of the coring bit, and wherein adjusting the rotating speed of the WOB motor is further based on the determined compressive strength of the formation.

3. The method of claim 1, wherein the controller is disposed in the downhole tool in the wellbore.

4. The method of claim 1, comprising:

measuring a WOB of the coring bit using a WOB sensor;

computing via the controller a target WOB based on the comparison of the computed ratio to the target ratio;

comparing via the controller the measured WOB to the target WOB; and automatically adjusting via the controller the rotating speed of the WOB motor based on the comparison of the measured WOB to the target WOB.

5. The method of claim 1, comprising:

measuring a rate of penetration (ROP) of the coring bit using a ROP sensor;

computing via the controller a target ROP based on the comparison of the computed ratio to the target ratio;

comparing via the controller the measured ROP to the target ROP; and automatically adjusting via the controller the rotating speed of the WOB motor based on the comparison of the measured ROP to the target ROP.

6. A method, comprising:

positioning a downhole tool in a wellbore extending into a subterranean formation;

commencing coring operations by rotating a coring bit of the downhole tool and extending the rotating coring bit into a sidewall of the wellbore;

measuring a weight on bit (WOB) of the coring bit using a WOB sensor;

measuring a rate of penetration (ROP) of the coring bit using a ROP sensor;

measuring a rotating speed of the coring bit using a bit rotating speed sensor;

measuring a torque at bit (TAB) using a TAB sensor;

computing via the controller a rock characteristic based on the measured WOB, measured ROP, measured rotating speed, and measured TAB;

computing via the controller a target rotating speed of the coring bit based on the computed rock characteristic;

comparing via the controller the computed target rotating speed to the measured rotating speed;

automatically adjusting via the controller a rotating speed of a bit rotation speed motor based on the comparison of the computed target rotating speed to the measured rotating speed;

computing via the controller a target ROP based on the computed rock characteristic;

comparing via the controller the computed target ROP to the measured ROP;

automatically adjusting via the controller a rotating speed of a WOB motor based on the comparison of the computed target ROP to the measured ROP.

* * * * *